US005501337A

United States Patent [19]

Sowden

[11] Patent Number: 5,501,337

[45] Date of Patent: Mar. 26, 1996

[54] ANALGESIC TABLET CONTAINER

[75] Inventor: Harry S. Sowden, Southampton, Pa.

[73] Assignee: McNeil-PPC, Inc., Milltown, N.J.

[21] Appl. No.: 308,012

[22] Filed: Sep. 16, 1994

[51] Int. Cl.[6] ..... B65D 83/04; B65D 85/42

[52] U.S. Cl. ..... 206/528.0; 206/535; 206/536

[58] Field of Search ..... 206/535, 536, 206/537, 538, 528, 540

[56] References Cited

U.S. PATENT DOCUMENTS

| | | | |
|---|---|---|---|
| 2,772,772 | 12/1956 | Taylor | 206/537 |
| 3,095,085 | 6/1963 | Meijer | 206/536 |
| 4,124,143 | 11/1978 | Thomas | 206/538 |
| 4,127,190 | 11/1978 | Sunnen | 206/538 |
| 4,288,006 | 9/1981 | Clover, Jr. | 206/538 |
| 4,807,757 | 2/1989 | Rappaport et al. | 206/535 |

*Primary Examiner*—Paul T. Sewell
*Assistant Examiner*—Marie Denise Patterson
*Attorney, Agent, or Firm*—Paul A. Coletti

[57] ABSTRACT

Applicant has invented a container for the tablets which contains a plurality of slots arranged in a radial fashion around the center of the container. Each of the slots are configured to accept at least one such frangible tablet. Each tablet is held within the slot and the tablet is constrained within the slot to move solely within the slot. The container contains a bottom and a lid. The bottom and the lid form constraining ends of the slots. The lid contains an opening which may be aligned with any one of the plurality of slots to provide an opening to the container and the ability to remove the tablet from the slot.

9 Claims, 3 Drawing Sheets

ANALGESIC TABLET CONTAINER

BACKGROUND OF THE INVENTION

Briefly, this invention relates to containers for analgesic tablets. More specifically, this invention relates to a tablet container which holds tablets in a predetermined, non-movable fashion.

SUMMARY OF THE INVENTION

Generally, analgesic tablets have been held within containers merely for purposes of placing certain predetermined dosages of such tablets within the containers. There has been very little attention placed upon holding the tablets specifically in certain positions within the containers. However, this situation is not true for tablets which are readily frangible. As an example of such tablets, there is an entire classification of freeze-dried type tablets which are very difficult to maintain in typical analgesic pill containers.

As a result, applicant has invented a container for the tablets which contains a plurality of slots arranged in a radial fashion around the center of the container. Each of the slots are configured to accept at least one such frangible tablet. Each tablet is held within the slot and the tablet is constrained within the slot to move solely within the slot. The container contains a bottom and a lid. The bottom and the lid form constraining ends of the slots. The lid contains an opening which may be aligned with any one of the plurality of slots to provide an opening to the container and the ability to remove the tablet from the slot.

DETAILED DESCRIPTION OF THE DRAWINGS

The invention will be better understood in connection with the appended drawings, wherein.

DETAILED DESCRIPTION OF THE INVENTION

Figure 1:
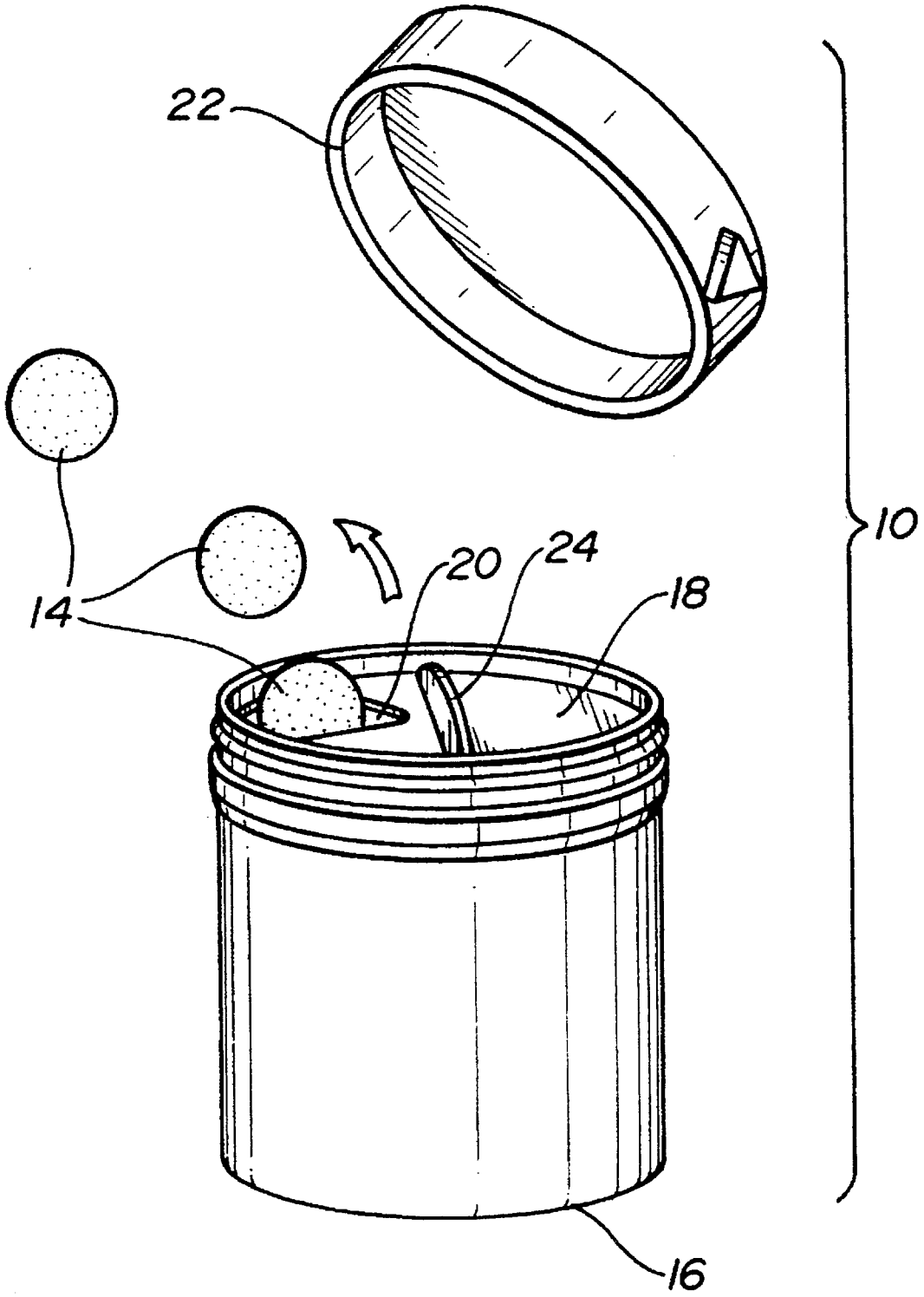
FIG. 1 is a perspective view of the container of the invention.
Figure 2:
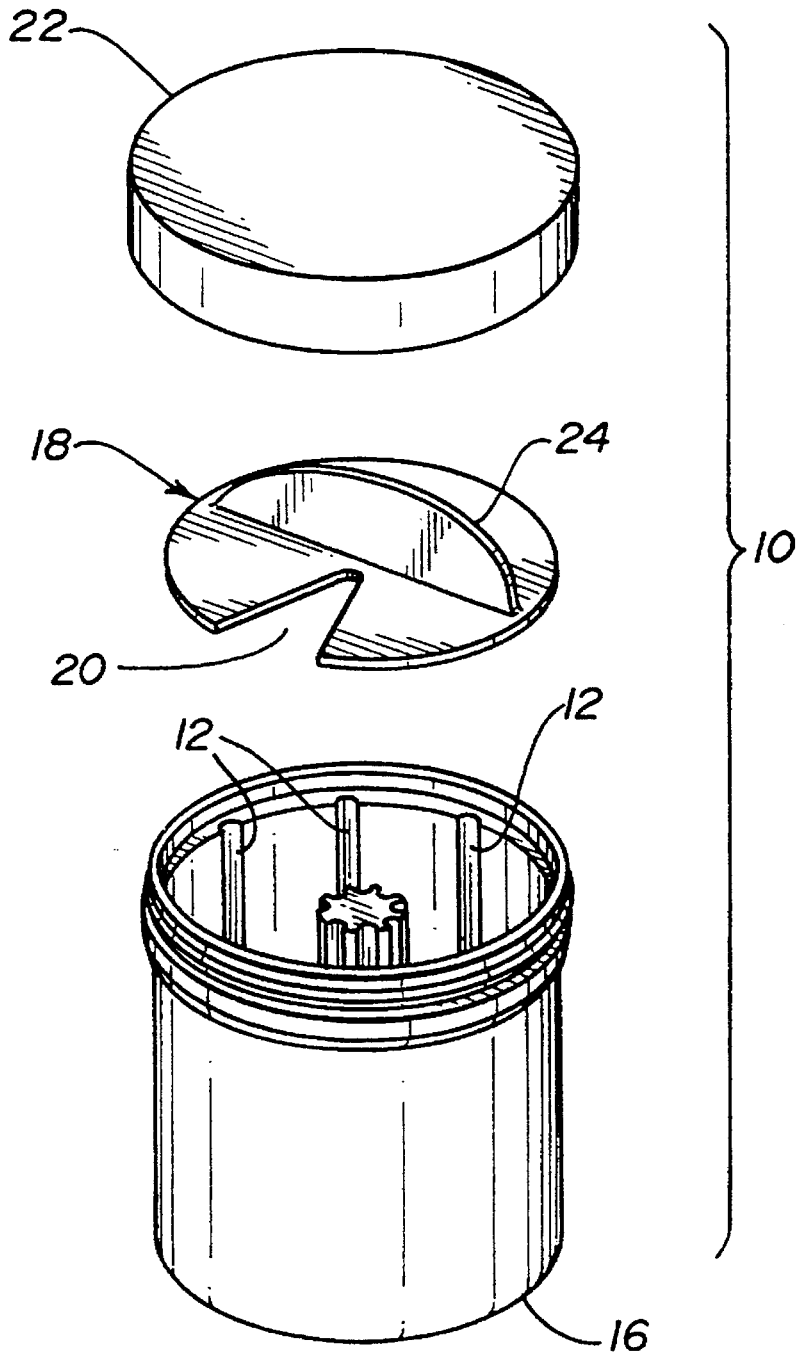
FIG. 2 is an exploded view of the container of the invention.
Figure 4:
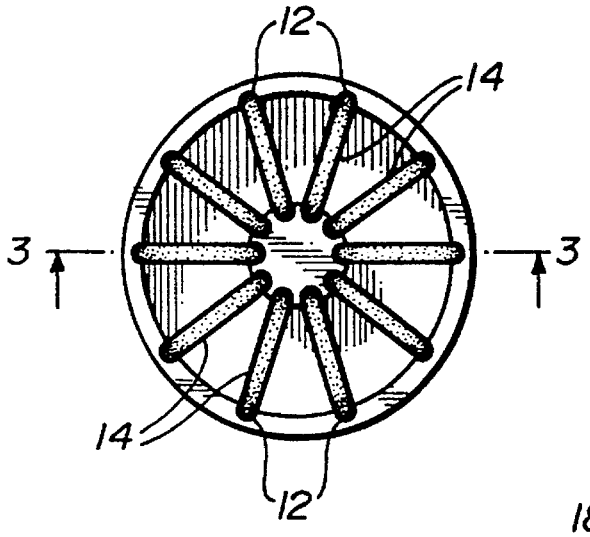
FIG. 4 is a top view of an opened container of the invention.
Figure 5:
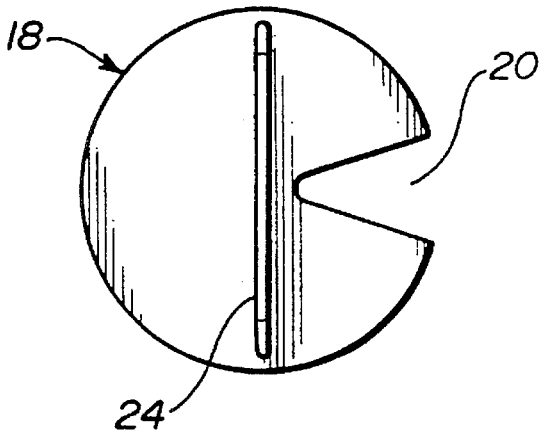
FIG. 5 is a top view of the rotatable lid of the container.
Figure 3:
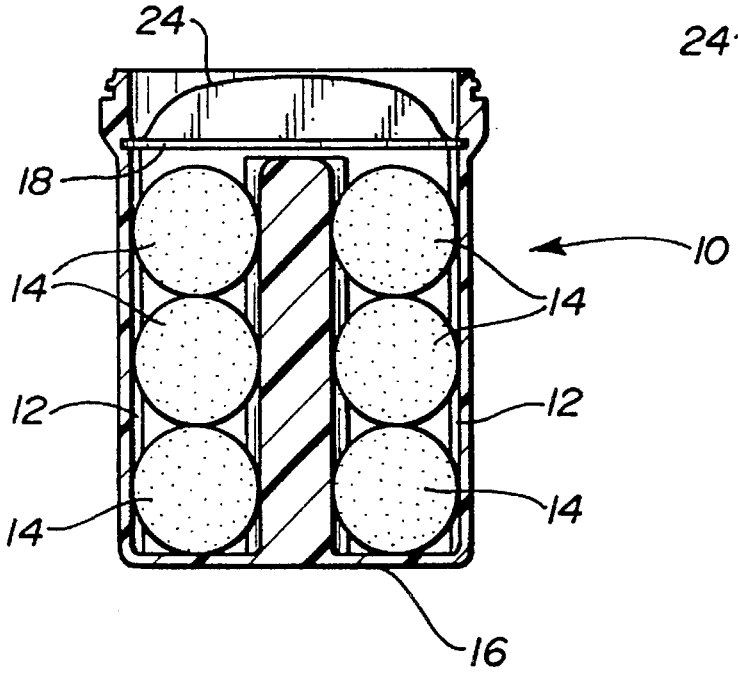
FIG. 3 is a cross-sectional view of the container of the invention taken along lines 3—3 of FIG. 4.

As can be seen from the figures, the invention comprises a container 10 which contains a plurality of slots 12 arranged in a radial fashion around the center. Each of the slots 12 is capable of holding a disk shaped tablet 14. Each of the tablets 14 fits comfortably and non-movably within the slots 12. Typically, there are three such tablets 14 able to be placed within a typical slot 12.

The bottom 16 of the container serves as a constraint for each of the slots 12. Similarly the top lid portion 18 of the container 10 serves as a further constraint for each of the slots. However, the lid portion 18 has formed in it an opening 20 which allows exposure of one of the slots 14 contained in the mechanism 10. Thus, the lid 18 may be rotated (via handle 24) to any particular slot 12, and thereafter a tablet 14 can be removed from such a slot 12. Of course, the opening 20 of the lid 18 can be placed between slots 12 so that no tablets 14 can be removed.

Thus, the container 10 of the present invention discloses a unique configuration wherein the tablets 14, which are typically frangible, can be held in an edge-to-edge relationship within a constrained fashion in the container. When there is a desired dosage required, the lid 18 of the container 10 can be rotated to the appropriate position, and the appropriate number of tablets 14 can removed from the container 10. However, when there is no need for a dosage, each of the tablets 12 can be held within the slot and prevented from breakage. As these frangible tablets 14 are typically more likely to break, the added constraint of the tablets, in such an edge-to-edge fashion causes the tablets 14 to be insured from breakage.

As further seen in the figures, the cap 22 of the container 10 prevents exposure of the lid 18 to any of the elements. Thus, the cap 22 serves further to prevent contamination of the tablets 14.

It will be appreciated if various modifications of the present invention are possible. For instance, the slots made be placed in parallel relationship; the slots may be arranged in sideways fashion; or, the lid may expose more than one slot at a time. In any event, the scope of the invention is not departed from. Of course, it is to be realized that the present invention is to be determined from the appended claims and their equivalents.

I claim:

1. A container for tablets comprising:

a plurality of slots arranged in a radial fashion about a center, each of said slots configured to accept at least one tablet, said slots formed as a pair of parallel grooves, wherein one of said grooves is located at the center of said container and the second of said grooves is located at a circumferential location about the center of said instrument;

at least one tablet held in a said slot, said tablet contained within said slot to move solely within said slot; and a bottom and a lid, said bottom and lid forming constraining ends of said slots, and wherein said lid contains an opening therein, said opening forming a passage therethrough to access a predetermined number of slots at any time.

2. The container of claim 1 wherein said tablets are disk shaped containing planar surfaces connected by a circumferential side and said slots are formed as a pair of parallel grooves configured to hold the side of said disk.

3. The container of claim 2 wherein there are at least two tablets contained in a said slot, and the tablets contained in said slots are placed in edge-to-edge relationship.

4. A container for holding tablets having a center and comprising:

at least on slot formed by a pair of parallel grooves, one of said grooves located at the center of said container and the second of said grooves located at a circumferential location about the center of said container; said slot enclosed by a bottom and a lid;

at least two tablets held in said slot in edge-to-edge relation; and said lid having an opening forming a passage therethrough to access a selected number of tablets from said slot at any time.

5. The container of claim 4 further comprising a plurality of said slots and each slot containing a plurality of tablets.

6. The container of claim 5 wherein said slots are arranged radially about the center of said container.

7. The container of claim 6 wherein said container is a cylinder.

8. The container of claim 4 wherein said container is a cylinder and contains a plurality of slots.

9. The container of claim 4 wherein said tablets are disk-shaped.

* * * * *